US008281689B2

(12) United States Patent
Laportella

(10) Patent No.: US 8,281,689 B2
(45) Date of Patent: Oct. 9, 2012

(54) TIGHTENING DEVICE

(76) Inventor: Pier Giorgio Laportella, Rome (IT)

( * ) Notice: Subject to any disclaimer, the term of this patent is extended or adjusted under 35 U.S.C. 154(b) by 0 days.

(21) Appl. No.: 13/509,205

(22) PCT Filed: Oct. 15, 2010

(86) PCT No.: PCT/IB2010/054689

§ 371 (c)(1),
(2), (4) Date: May 25, 2012

(87) PCT Pub. No.: WO2011/058464

PCT Pub. Date: May 19, 2011

(65) Prior Publication Data

US 2012/0227356 A1 Sep. 13, 2012

(30) Foreign Application Priority Data

Nov. 12, 2009 (IT) ..... RM2009A0584

(51) Int. Cl.
*B67B 7/18* (2006.01)
*B25B 13/48* (2006.01)

(52) U.S. Cl. ..... 81/3.32; 81/3.42

(58) Field of Classification Search ..... 81/3.07, 81/3.08, 3.25, 3.31, 3.32, 3.33, 3.36, 3.37, 81/3.39, 3.4, 3.42, 3.44, 186; 7/151; D8/33, D8/37

See application file for complete search history.

(56) References Cited

U.S. PATENT DOCUMENTS

| | | | | | |
|---|---|---|---|---|---|
| 807,613 | A * | 12/1905 | Graves | 81/3.32 |
| 1,841,270 | A * | 1/1932 | Aeschbach et al. | 81/3.25 |
| 2,599,114 | A | 6/1952 | Lober | |
| 3,724,296 | A * | 4/1973 | Graver | 81/3.25 |
| 4,955,262 | A | 9/1990 | Womack et al. | |
| 6,854,361 | B2 * | 2/2005 | Vandergaw | 81/3.4 |
| 2003/0061912 | A1 * | 4/2003 | Battles et al. | 81/3.44 |

OTHER PUBLICATIONS

PCT International Search Report for PCT/IB2010/054689 filed Oct. 15, 2010 in the name of Pier Giorgio Laportella. Mail date: Mar. 14, 2011.

PCT Written Opinion for PCT/IB2010/054689 filed Oct. 15, 2010 in the name of Pier Giorgio Laportella. Mail date: Mar. 14, 2011.

* cited by examiner

*Primary Examiner* — David B Thomas
(74) *Attorney, Agent, or Firm* — Steinfl & Bruno LLP

(57) ABSTRACT

A tightening device is described. The tightening device can be utilized for facilitating the operation of rotation of items mutually coupled by means of closing and locking systems of rotating, screw, bayonet type, or the like.

15 Claims, 11 Drawing Sheets

TIGHTENING DEVICE

CROSS REFERENCE TO RELATED APPLICATIONS

The present application is the US national stage of International Application PCT/IB2010/054689 filed on Oct. 15, 2010, which, in turn, claims priority to Italian Patent Application RM2009A000584 filed on Nov. 12, 2009.

The present description refers to a tightening device, in particular for facilitating the operation of rotation of items mutually coupled by means of closing and locking systems of rotating, screw, bayonet type, or the like.

Examples of this kind of activity may be the opening and/or closing of containers having a cap, for instance jars having a screw cap, "moka pots" (stove top espresso coffee maker) or the like, the positioning and/or removal of box-type bodies cylindrical or anyhow difficult to grip, like e.g. oil filters for vehicles, etc.

It is well-known that operations such as the above-indicated ones, or of course operations similar or referable to the examples discussed, entail in some cases objective difficulties.

Such difficulties mainly occur when the items to be coupled or uncoupled are of a substantially cylindrical shape, or particularly bulky and anyhow having a particularly strong coupling.

Let us consider, e.g., the case of elders, women or children grappling with jars of various type, in particular of glass, under vacuum, the opening of which is notoriously difficult.

Oft-times, gripping said typically smooth containers with the hands is extremely difficult, and applying a minimum force required to unscrew their cap is even more difficult.

Moreover, such an operation requires holding with one hand the actual container, while attempting with the other one to exert a force sufficient to rotate the cap.

Some devices contrived to facilitate this type of operations are known.

To a first category belongs a whole array of gripping devices, substantially large pincers, with which it is possible to grab the cap of the container and then, by exploiting the lever provided by the device, exert a greater force on the cap.

However, for these devices, there remains the drawback of having to be used with a single hand, while the other hand holds the container. This anyhow entails a distribution of the force on the two portions of the jar.

A second category of devices provides a base to be fixed to a working plane, base having a shaped seat apt to receive exactly a certain type of containers. An example of this type of devices is the bases for screwing/unscrewing moka-type pots, which have a standard polygonal-section base.

However, these devices can be used exclusively with those items having a base with a standard and anyhow not circular section.

In fact, no seat having to be circular might hold a just as circular container subjected to an action of rotation.

Moreover, this type of devices envisages the exact knowledge of the shape of the basis to be inserted and therefore cannot be "universal" and concomitantly adapt to plural shapes and/or plural dimensions of the same item.

Therefore, object of the present invention is to provide an innovative solution to the problems still left open by the known art, by providing a tightening device as defined in independent claim 1.

Secondary features of the present invention are instead set forth in the corresponding dependent claims thereof.

As will be illustrated hereinafter in the description, the present invention entails several advantages.

First of all, at least according to some of the embodiments, it allows to concentrate the force of both hands on a single portion of the item, e.g. on a jar cap, while the container remains constrained to the bearing plane.

Moreover, it can be used both to couple and uncouple parts of items positionable and/or removable by means of a rotary motion.

Moreover, according to the present invention the device is adjustable, therefore adaptable to any container type/shape/size.

This and further advantages, as well as the features and operation steps of the present invention, will be made apparent in the following detailed description of an embodiment thereof, given by way of example and not for limitative purposes. Reference will be made to the figures of the annexed drawings, wherein:

FIGS. 1 and 2 schematically illustrate a device according to the present invention;

FIGS. 3A and 3B schematically illustrate the operation principle of a device according to the present invention;

Figure 14:
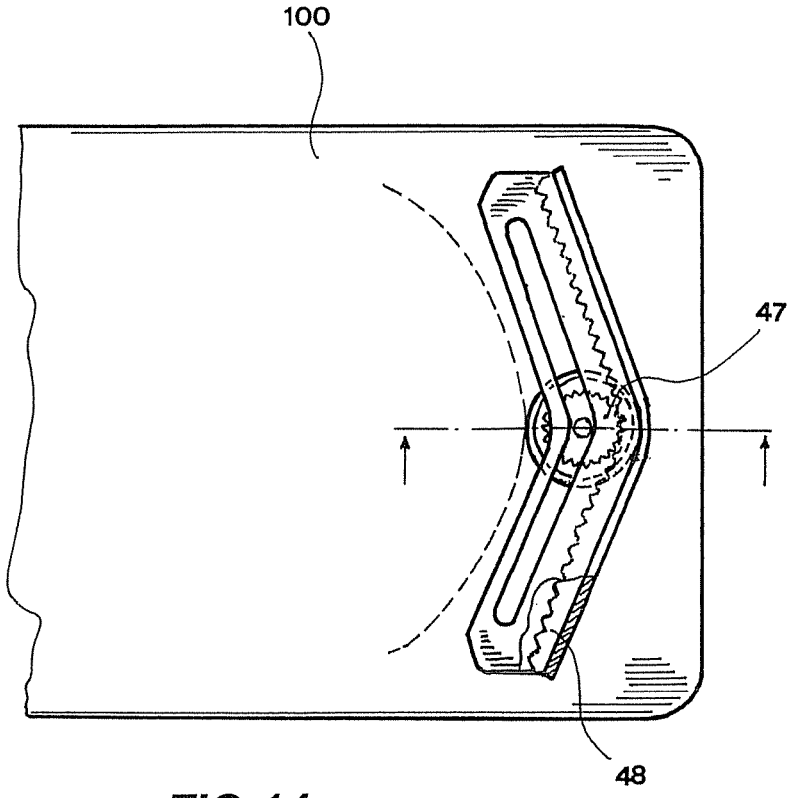
Figure 14B:
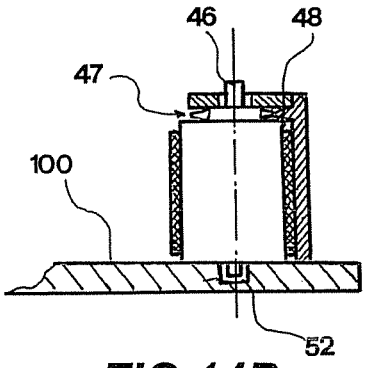
Figure 14A:
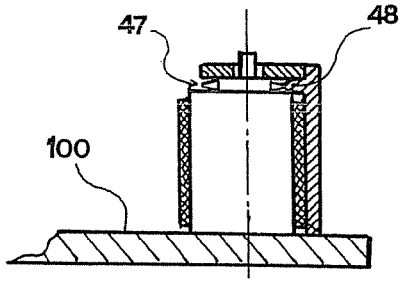
Figure 15:
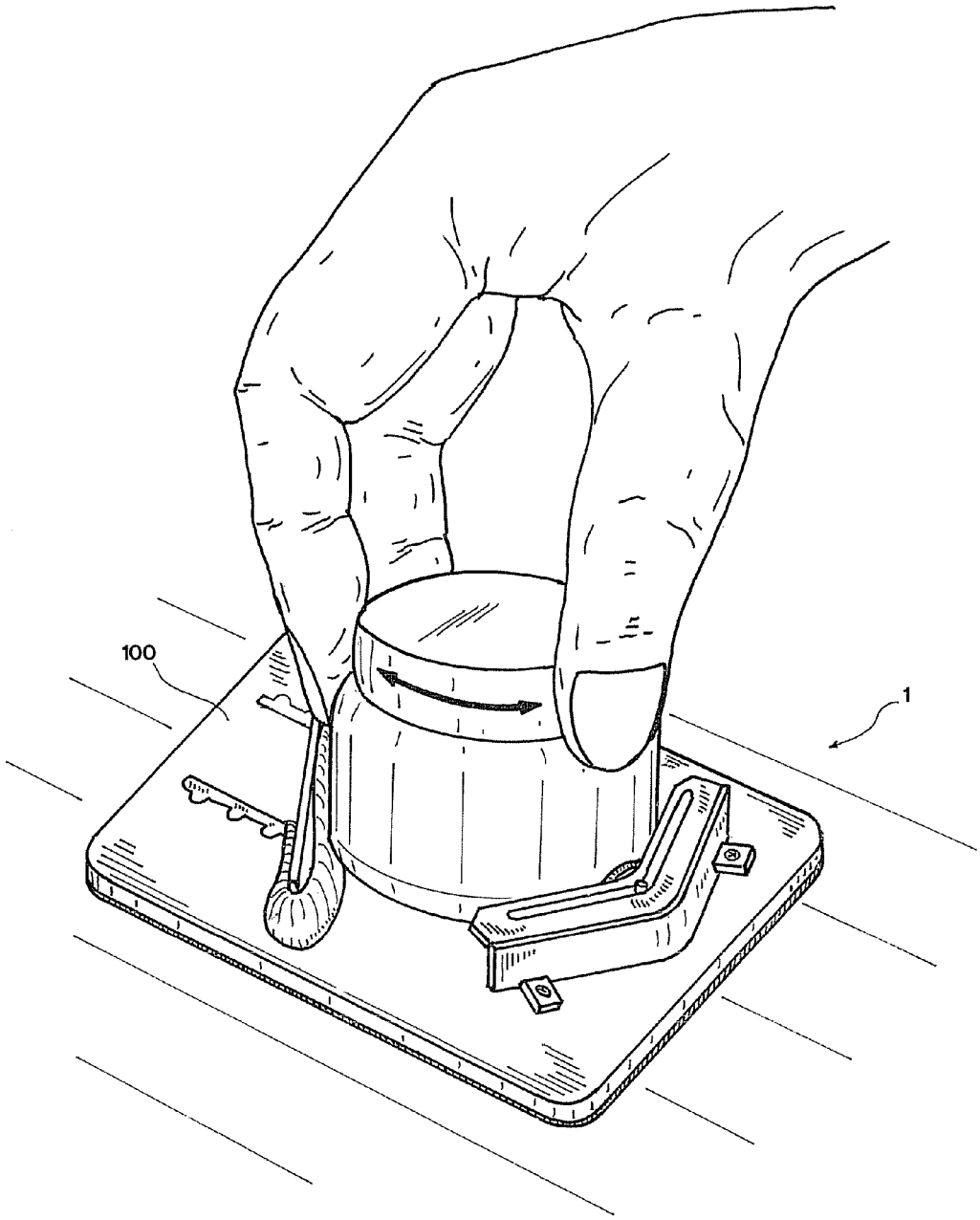
Figure 16A:
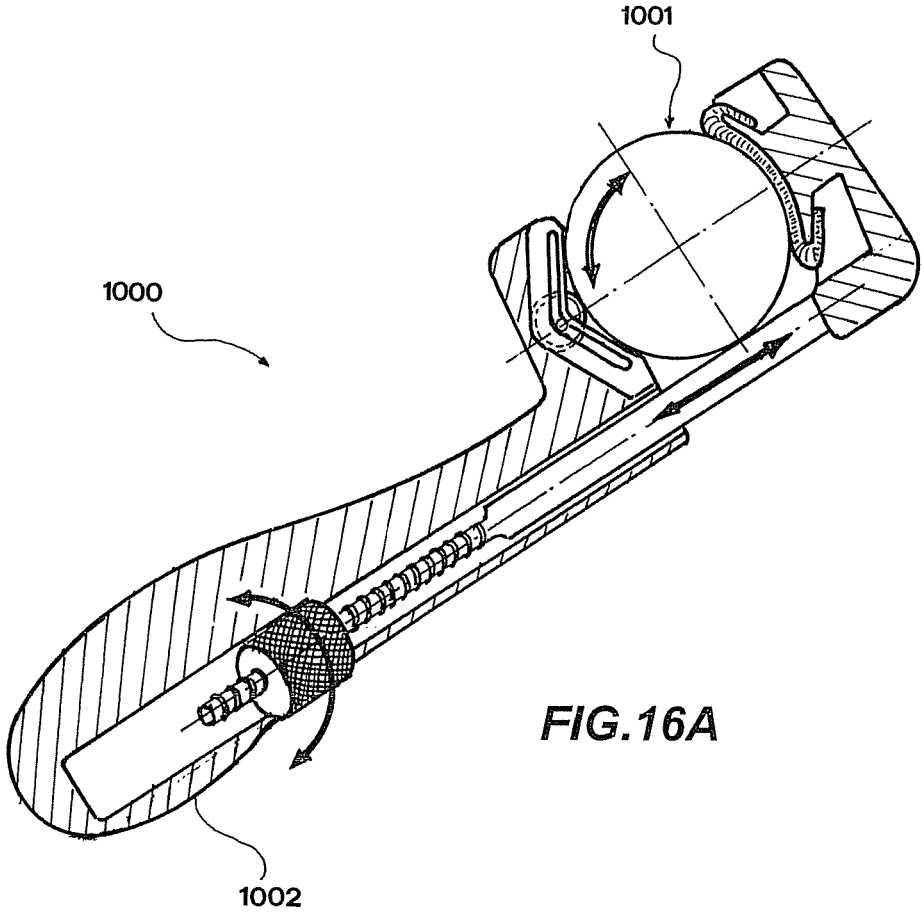
Figure 16B:
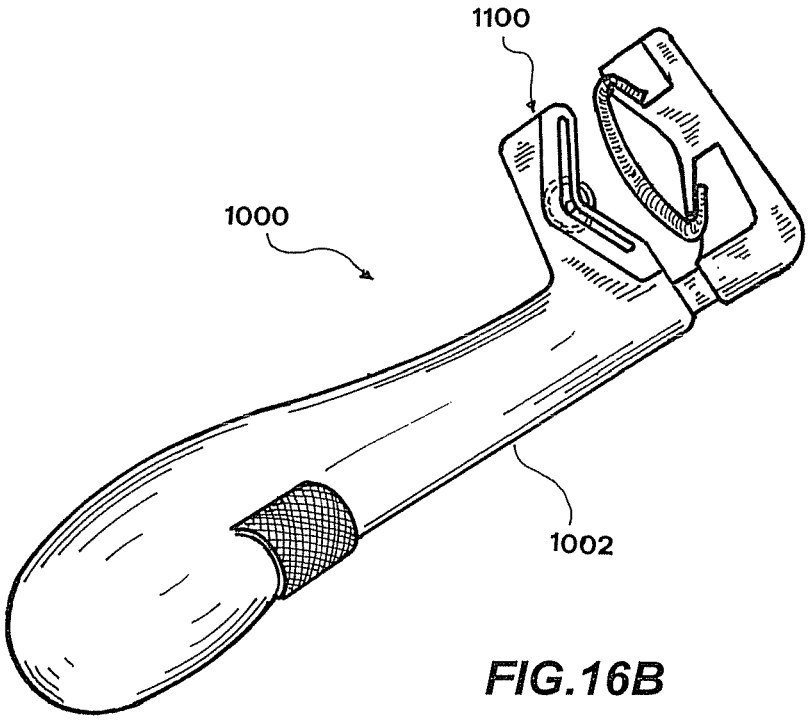

FIGS. 14 and 14A refer to a second implementation variant of the holding element and of the tightening element;

FIG. 14B illustrates a further embodiment, possible both in the first and the second variant;

FIG. 15 illustrates an example of use of a device according to the present invention; and FIGS. 16A and 16B show a second embodiment of the device according to the present invention, made in the form of pincers.

The present invention will be detailed hereinafter, making reference to the above-indicated figures.

Figure 1:
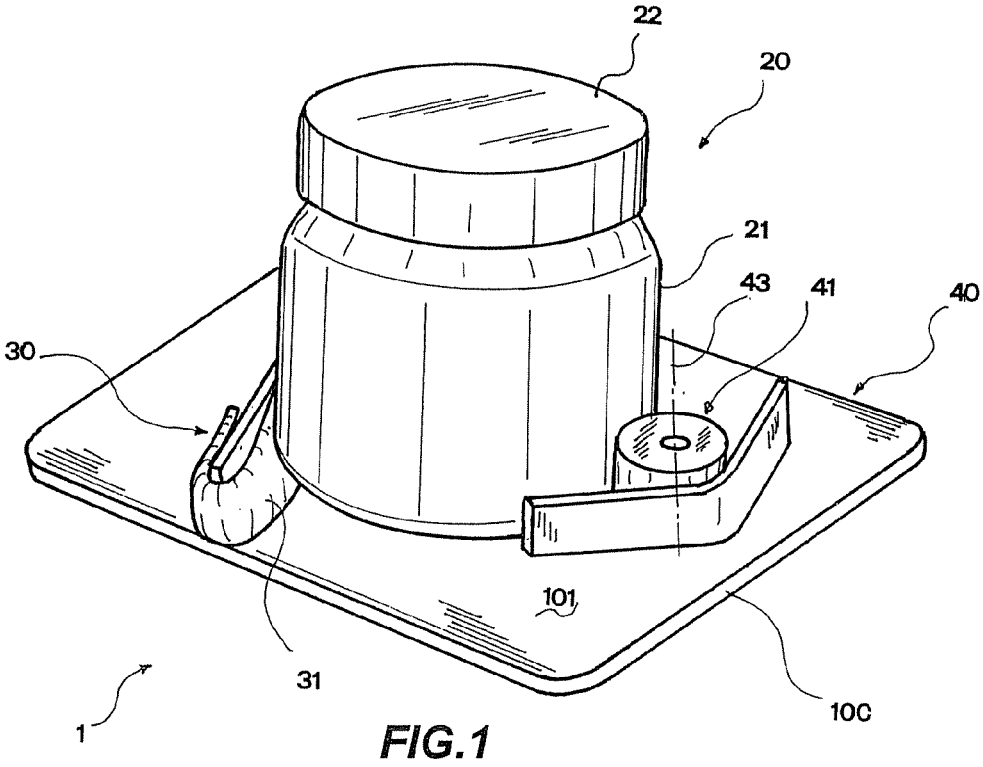

Referring initially to FIG. 1, it shows a device according to the present invention, schematically illustrated in order to make its operation principle easily understandable.

A tightening device 1 according to the present invention can be used to tighten an item 20 comprising a portion 21 positionable or removable by means of a rotary motion.

By way of example, FIG. 1 illustrates the operation of the device 1 used to position or remove a cap 22 from a container 21 of the jar 20.

Figure 2:
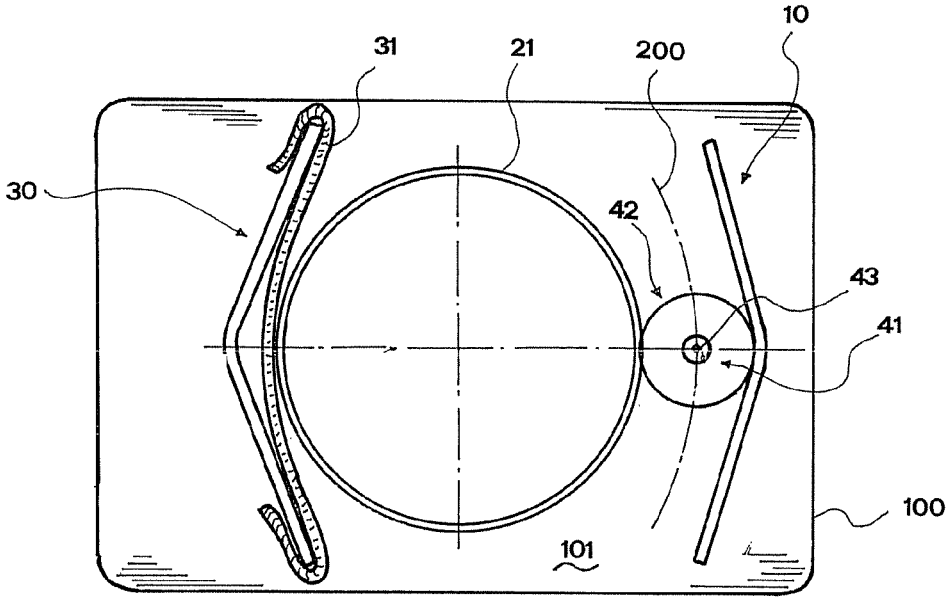

Making reference also to next FIG. 2, the device 1 comprises first of all a first holding element 30 having a first working surface 31.

Such a surface 31 is preferably made of a material apt to generate substantial friction when into contact with the portion 21 of the jar 20.

Moreover, the device 1 comprises a second holding element 40. The holding element 40 in turn comprises a tightening element 41.

The tightening element 41 has, along its side walls, a second working surface 42, it also made of a material apt to produce substantial friction on the portion 21 of the jar.

The two holding elements are arranged therebetween in a manner such that the two working surfaces 31 and 42 are opposite therebetween.

In particular, the two holding elements 30, 40 are mounted on a support 100. The support 100 defines an ideal working plane 101.

Such a tightening element may be made of different shapes, in particular of a cylindrical shape, or of a spherical, elliptical shape or the like.

For simplicity's sake in the description, hereinafter reference will always be made to the case in which the tightening element is cylindrical.

In any case, the tightening element 41, be it cylindrical or spherical, is apt to rotate about an axis of rotation 43 orthogonal to said ideal working plane 101 and is constrained to move on said plane 101 along a substantially C- or V-like path 200 having a concavity giving onto the first working surface 31.

The two holding elements should be arranged in a manner such that their mutual distance be such that the portion 21 of the jar 20, when placed on the device, be concomitantly into contact with the first working surface 31 and with the second working surface 42.

Figure 3A:
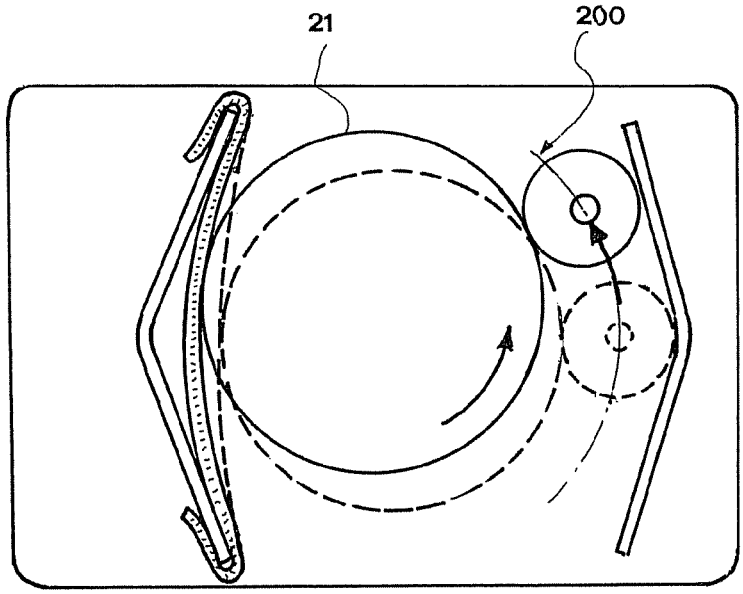
Figure 3B:
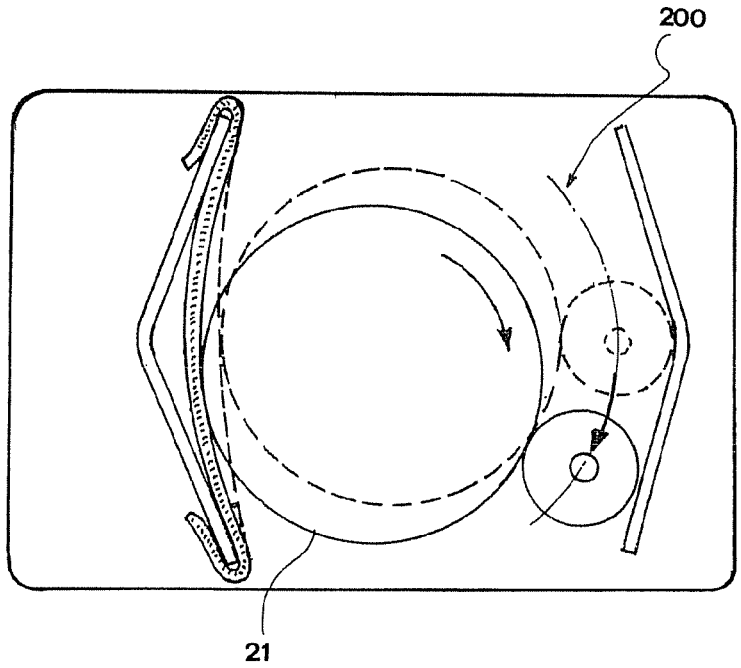
Figure 4A:
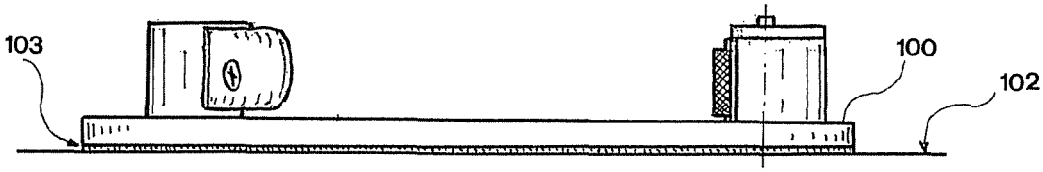
FIGS. 4A and 4B show two different fastening modes of the device on a bearing plane.
Figure 4B:
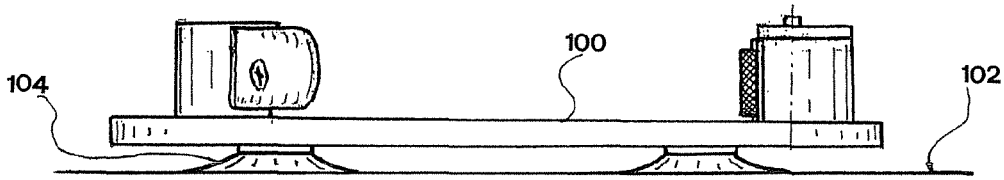
Figure 5:
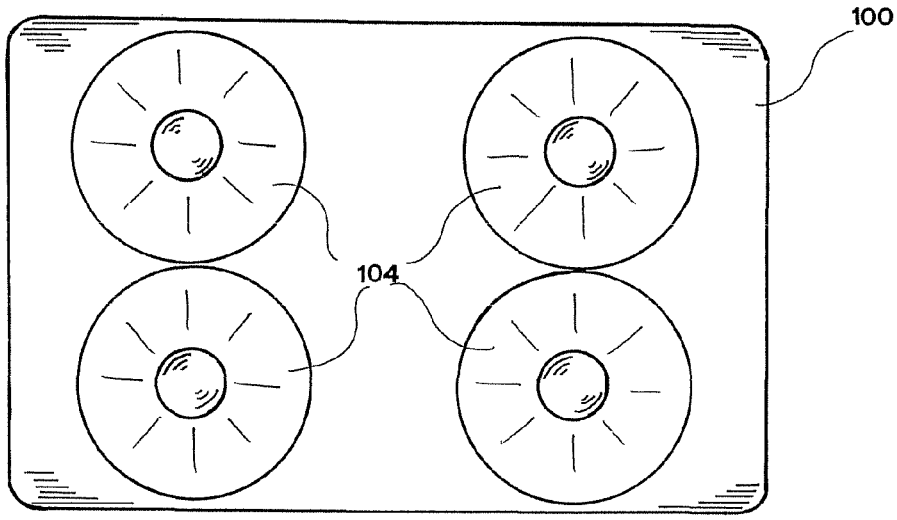
FIG. 5 is a bottom plan view of the device of FIG. 4B.

Next FIGS. 3A and 3B illustrate, always in an extremely schematic manner, the operation of the device.

To use the device, an external force should be applied which be apt to impart a rotary motion to the portion 21 or, as will be apparent hereinafter, to the device itself.

This occurs, e.g., by exerting with the hands a force on the cap 22, in an attempt to unscrew it or, on the contrary (as in FIG. 3B) to tighten it onto the container 21.

When such a force is applied, between the portion 21 and the two working surfaces 31 and 42 a substantial rolling friction is generated, causing a rotation of the tightening element 41 about its axis 43 and a movement thereof along the path 200.

This causes, as a consequence, a reduction of the distance between the working surfaces and a consequent tightening of the portion 21.

For a correct and ideal operation of the device, the constraint imposed on the tightening element is relevant; the latter is forced to rotate about its axis, concomitantly moving along the path 200.

As will be better described hereinafter, such a constraint and the path 200 can be made in various ways, for instance by means of a guide element.

Preferably, the first holding element 30 comprises an elastic holding element 33, a surface thereof constituting said first working surface 31.

The advantage of having an elastic working surface available is expressed by a greater ease of adaptation of the device to different sizes of the item 20.

According to an alternative embodiment, the first holding element 30 comprises a rigid element having a linear-shaped, or C-shaped or V-shaped plan profile, in this case with a concavity giving onto the second working surface 42. On said rigid element the first working surface 31 is made, e.g. with a layer 31 of material having a high friction coefficient (rubber or the like).

According to a first embodiment, the two holding elements 30 and 40 are both mounted on a single support 100.

In this case, the device can be advantageously used, e.g., to remove a cap from a jar.

To this end, the device has to be firmly lockable on a bearing plane 102.

This locking is obtained with means 103, 104 for locking said support 100 on a bearing plane 102. In particular, such locking means 103, 104 may be made as a non-slip mat 103, or as a plurality of sucker elements 104.

Of course, it is understood that other locking modes could be used, preferably removable ones such as, e.g., a clamp or screws.

Next FIGS. 6A to 10 refer to the advantageous option of making the device operational and functional with different sizes of jars or items 20.

To this end, it is advantageously equipped with means for adjusting the distance between said first and second holding elements 30 and 40.

Such adjusting means will presently be described, according to some operation modes thereof, purely by way of example. It is understood that other modes could be implemented, though keeping the adjustment concept unaltered, e.g. by making movable the one, the other or both between the holding elements.

Hereinafter, reference will be made to the case in which it is the first holding element which is movable with respect to the other one.

Figure 6A:
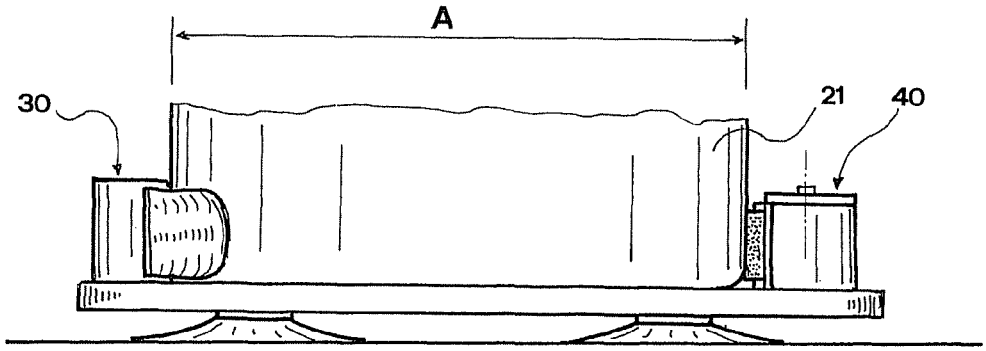
FIGS. 6A, 6B and 6C illustrate the adjustment function of the device.
Figure 6B:
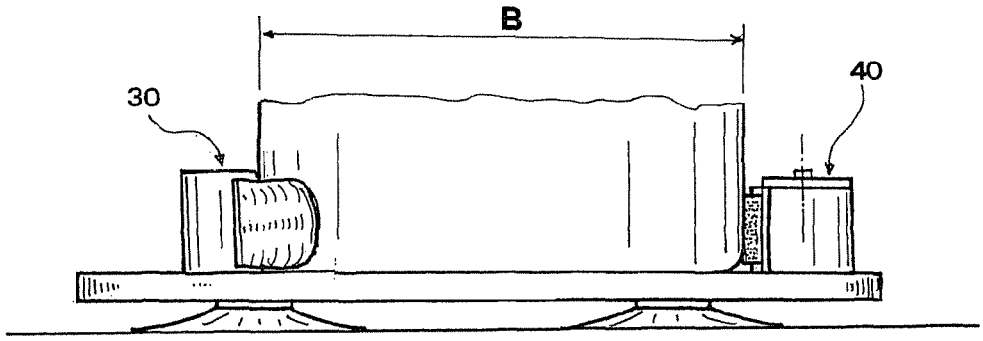
Figure 6C:
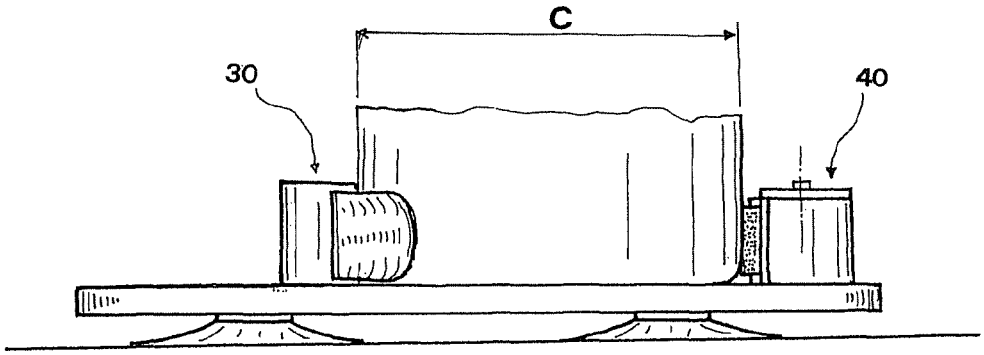

In general, as illustrated in FIGS. 6A, 6B and 6C, for the first holding element three different positions might suffice to allow use of the device with containers of various diameter A, B, C, from larger (FIG. 6A) to smaller (FIG. 6C) ones.

Advantageously, the shifting (movement) of the holding element 30 may be provided in a finite number of positions.

Figure 7A:
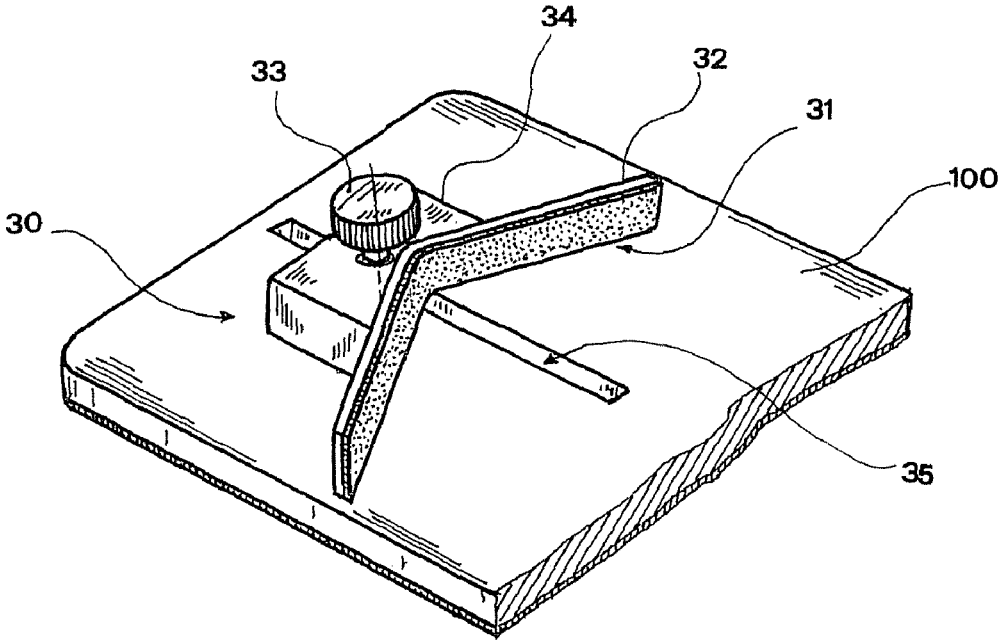
FIGS. 7A to 10B show different implementation modes of the adjustment mechanism.
Figure 7C:
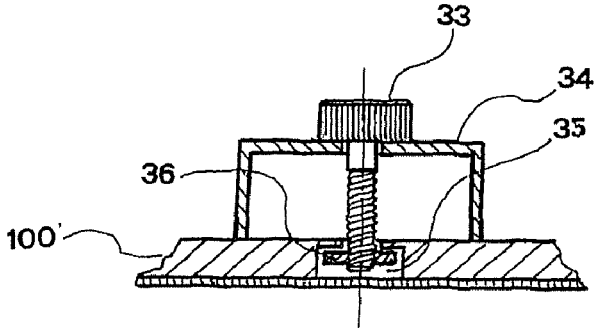
Figure 7B:
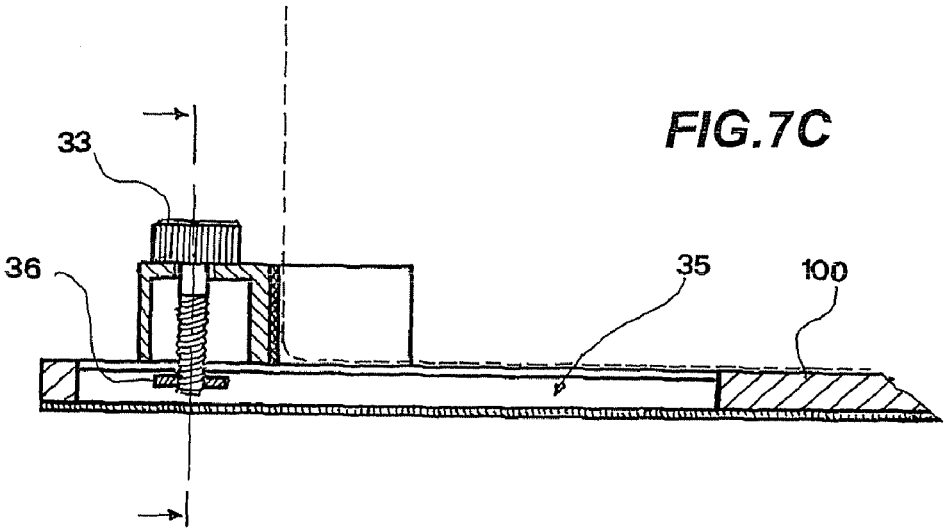

FIGS. 7A, 7B and 7C refer to a preferred implementation mode of the movement mechanism. In particular, a recess guide 35 is provided, made on the support 100, along a longitudinal shifting line.

The holding element 30 comprises a thrust element 34, integral to the holding group 31, 32 which, in this case, provides a rigid element 32 having a C-shaped or V-shaped or even a linear-shaped plan profile, with a concavity giving onto said second working surface 42 and a first working surface 31 made with a layer of material having a high friction coefficient and placed directly on said rigid element.

A screw element, operable by means of a knob 33, cooperates with a nut 36 housed into the guide recess 35 where it can slide.

Then, upon positioning the holding element 30 in the desired position, it will suffice to tighten the knob 33 in order to lock the element 30 in that position.

Figure 8:
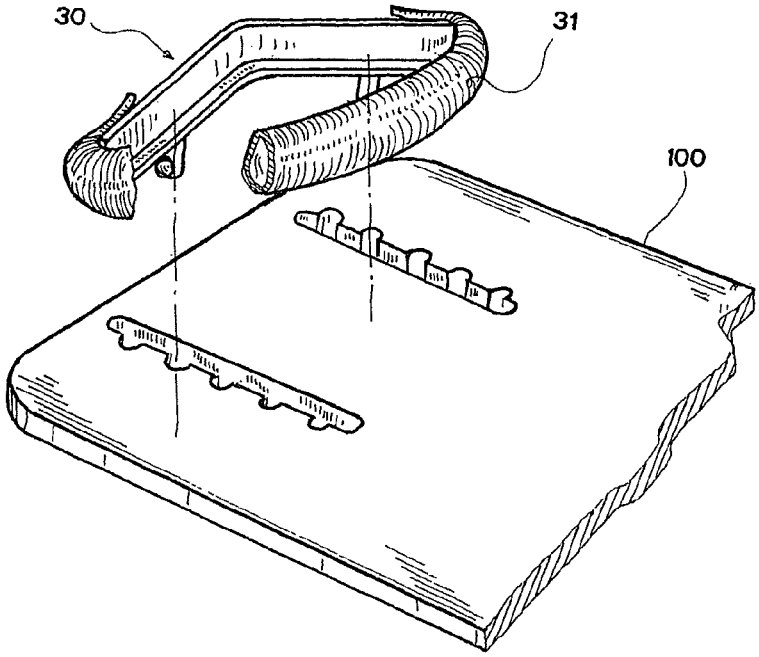
Figure 9:
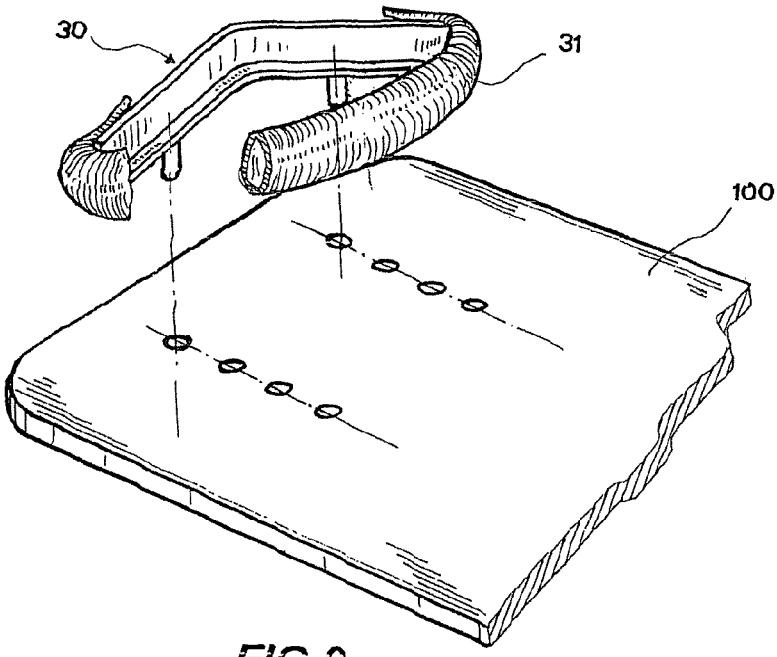

FIGS. 8 and 9 refer to two possible implementation modes of this movement mechanism, in which the holding element 30 is positioned in a pair of holes or of sliding guides and locked in a certain position on the support 100.

Figure 10A:
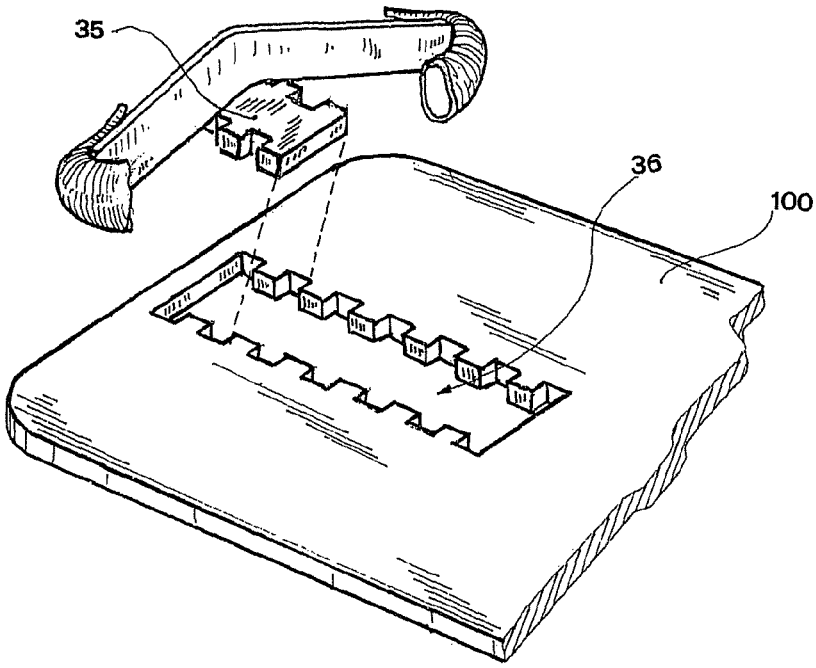
Figure 10B:
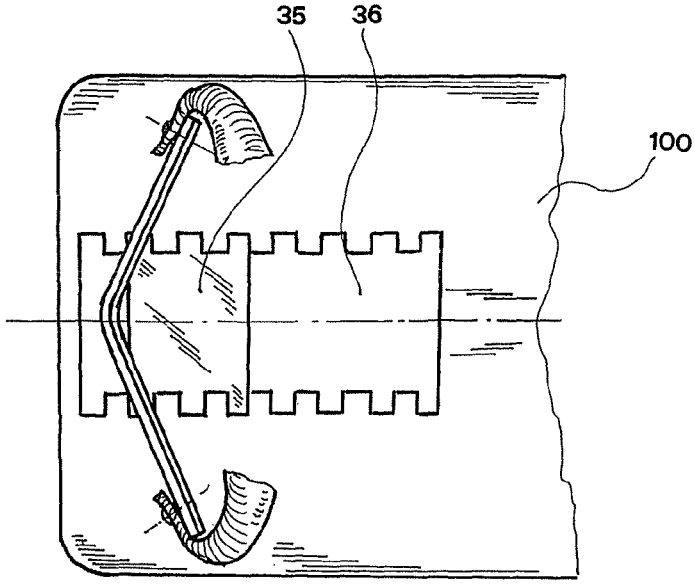
Figure 11:
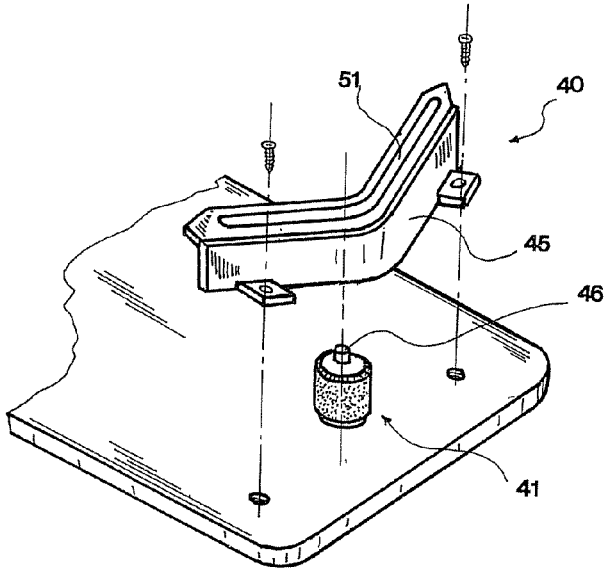
FIGS. 11 to 13A show a first implementation variant of the holding element and of the tightening element.
Figure 12:
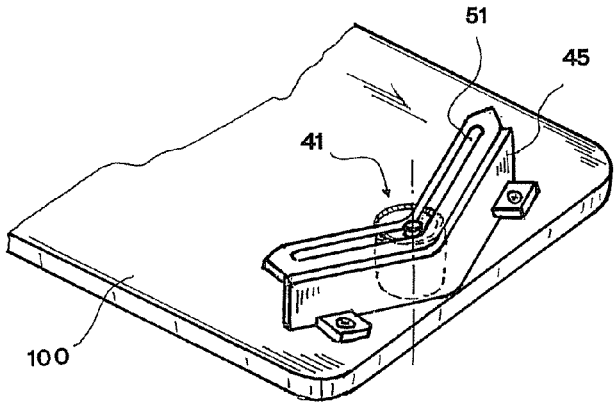
Figure 13:
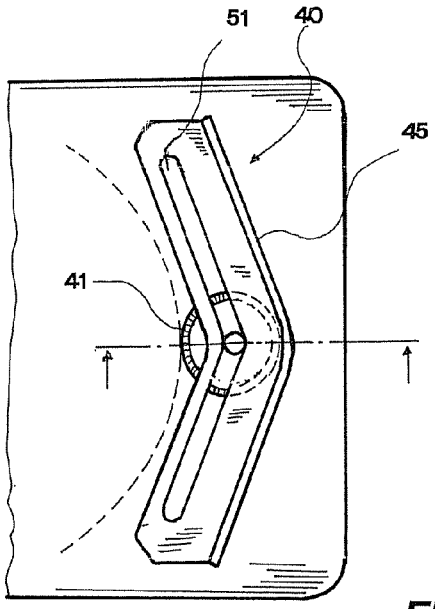
Figure 13A:
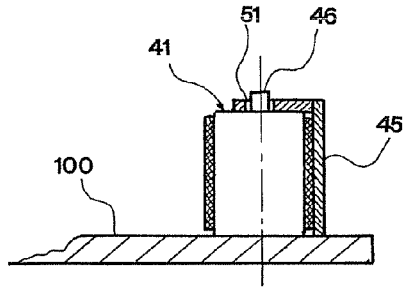

FIGS. 10A and 10B refer instead to a different embodiment of the adjustment and movement mechanism. The holding element 30 in this case comprises a shaped insert 35, which can be housed in a recess 36 obtained on the support 100. The insert 35 may be positioned in a plurality of positions along said recess, depending on the diameter of the item to be held.

An advantageous aspect of this embodiment derives from the fact that, during operation of the device, the insert 35 comes to be below the bottom of the jar inserted on the device. This contributes to support the holding element itself during the tightening operation, the latter being subjected to a remarkable reaction force.

Next FIGS. 11 to 13A refer to the second holding element 40.

According to a first variant, the second holding element 40 has a rolling portion 45.

This rolling portion 45 has a C-shaped or V-shaped plan profile, with a concavity giving onto the first working surface 31.

Said rolling portion acts substantially as a guide element for the tightening element 41, which is constrained by friction to roll on it.

Advantageously, the second holding element 40 comprises one or more guides 51, 52, arranged along said path 200, inside which said tightening element 41 is positioned by means of respective axial pins 46. In particular, the presence of a top guide 51 is provided, in order to make stable the mounting of the tightening element in the device.

According to a construction variant, at least one of the axial pins, preferably the top one 46, comprises a respective coaxial gear wheel 47, meshing on a respective rack 48 placed along said path 200, e.g. on the guide 45.

Advantageously, according to the latter variant embodiment, the presence of the rolling portion is not required anymore, as the constraint for the rolling of the tightening element is made by the gear wheel/rack pair.

FIG. 14B illustrates a variant in which the tightening element has two opposite axial pins, one cooperating with the guide 51, as described hereto, and one cooperating with a guide recess 52 obtained, e.g., directly on the support 100.

FIGS. 16A and 16B refer to a second embodiment of a tightening device according to the present invention.

According to this second embodiment, the device 1000 can advantageously be used to tighten, screw or unscrew items 1001, in particular cylindrical ones.

According to this embodiment, the device is made as a pincers with a grip element (portion) 1002, wherein each jaw respectively comprises one of the holding elements made in any one of the variants described hereto.

The distance between the two jaws, and therefore between the two holding elements, is in this case as well adjustable by adjusting means, e.g. screw ones or the like.

The operation of the device and the principle underlying its operation are again those described in the foregoing, based substantially on the generation of a rolling friction between the wall of the tightening element and the item to be tightened, and a constraint on the tightening element which is forced to rotate about its axis and concomitantly to move along a predefined path when on the item, or as in this case on the device, a force is exerted which tends to rotate it.

The present invention has been hereto described with reference to preferred embodiments thereof. It is understood that other embodiments might exist, all falling within the concept of the same invention, and all comprised within the protective scope of the claims hereinafter.

The invention claimed is:

1. A device for tightening an item comprising a portion positionable or removable by means of a rotary motion, said device comprising:

a first holding element having a first working surface of a material apt to produce a substantial friction on said portion;

a second holding element, comprising a tightening element having a second working surface of a material apt to produce a substantial friction on said portion and opposite to said first working surface; and a support onto which said first and second holding elements are mounted, apt to define an ideal working plane, wherein:

said tightening element is apt to rotate about an axis of rotation orthogonal to said ideal working plane and is constrained to move on said plane along a substantially C- or V-like path having a concavity giving onto said first working surface, the distance between said first and second holding elements is such that said portion of said item is concomitantly in contact with said first working surface and said second working surface, and said first working surface and said tightening element are configured such that, when an external force apt to impart a rotary motion to said portion or said device is applied, generated rolling friction results in a rotation of said tightening element about its axis and a movement of said tightening element along said path, reducing the distance between said working surfaces and causing the tightening of said portion.

2. The device according to claim 1, wherein said first holding element comprises an elastic holding element, a surface of said first holding element constituting said first working surface.

3. The device according to claim 1, wherein said first holding element has a first working surface having a linear-shaped, or C-shaped or V-shaped plan profile, with a concavity giving onto said second working surface.

4. The device according to claim 1, comprising means for adjusting the distance between said first and second holding elements.

5. The device according to claim 4, wherein said adjusting means comprises a mechanism for movement of one or both of said first and second holding element.

6. The device according to claim 5, wherein said mechanism allows shifting of one or both of said first and second holding element in a finite number of positions.

7. The device according to claim 1, wherein said second holding element has a rolling portion having a C-shaped or V-shaped plan profile, the C-shaped or V-shaped plan profile having a concavity giving onto said first working surface, said tightening element being constrained to roll along said rolling portion.

8. The device according to claim 1, wherein said second holding element comprises one or more guides, arranged along said path, inside which said tightening element is positioned by means of respective axial pins.

9. The device according to claim 8, wherein said axial pins comprise respective gear wheels meshing on respective racks placed along said one or more guides.

10. The device according to claim 1, further comprising means for locking said support on a bearing plane.

11. The device according to claim 10, wherein said locking means comprises a non-slip mat.

12. The device according to claim 10, wherein said locking means comprises a plurality of sucker elements.

13. The device according to one of the claims 1, wherein said support comprises a grip portion.

14. The device according to claim 1, wherein said tightening element is of a cylindrical shape.

15. The device according to claim 1, wherein said tightening element is of a substantially spherical shape.

* * * * *